US011043733B2

(12) United States Patent
Wang et al.

(10) Patent No.: US 11,043,733 B2
(45) Date of Patent: Jun. 22, 2021

(54) TERMINAL HOUSING AND TERMINAL

(71) Applicant: BEIJING XIAOMI MOBILE SOFTWARE CO., LTD., Beijing (CN)

(72) Inventors: Linchuan Wang, Beijing (CN); Bingxiao Wang, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 0 days.

(21) Appl. No.: 16/538,814

(22) Filed: Aug. 12, 2019

(65) Prior Publication Data

US 2020/0067177 A1 Feb. 27, 2020

(30) Foreign Application Priority Data

Aug. 23, 2018 (CN) ..... 201810972185.0

(51) Int. Cl.
*H01Q 1/24* (2006.01)
*H01Q 1/44* (2006.01)
(Continued)

(52) U.S. Cl.
CPC ..... *H01Q 1/243* (2013.01); *H01Q 1/241* (2013.01); *H01Q 1/242* (2013.01); *H01Q 1/44* (2013.01);
(Continued)

(58) Field of Classification Search
CPC ..... H01Q 1/243; H01Q 1/44; H01Q 1/48; H01Q 21/08; H01Q 21/0075; H01Q 13/106; H01Q 1/242; H01Q 1/24; H01Q 1/50
See application file for complete search history.

(56) References Cited

U.S. PATENT DOCUMENTS 9,105,966 B1 8/2015 Dou et al.
9,203,137 B1 * 12/2015 Guterman ..... H01Q 1/243
(Continued)

FOREIGN PATENT DOCUMENTS

CN 206076482 U 4/2017
CN 206628601 11/2017
(Continued)

OTHER PUBLICATIONS

Yu Bin et al: "A Novel 28 GHz Beam Steering Array for 5G Mobile Device With Metallic Casing Application", IEEE Transactions on Antennas and Propagation, IEEE Service Center, Piscataway, NJ, US, vol. 66, No. 1, Jan. 1, 2018 (Jan. 1, 2018), p. 1-p. 3; figures 1-6.
(Continued)

*Primary Examiner* — Vibol Tan
(74) *Attorney, Agent, or Firm* — Syncoda LLC; Feng Ma

(57) ABSTRACT

A terminal housing includes: a bottom metal frame, a feed line and a communication module, wherein a plurality of through holes are formed in the bottom metal frame; each through hole is filled with a dielectric, and a feeding point and a grounding point are arranged at each side of each through hole, respectively; one end of the feed line is connected with a radio frequency port of the communication module; and another end of the feed line crosses the dielectric in each through hole to be connected with the corresponding feeding point, so as to enable the bottom metal frame and the dielectrics in the plurality of through holes to form an antenna unit.

19 Claims, 5 Drawing Sheets

(51) Int. Cl.
*H01Q 1/48* (2006.01)
*H01Q 13/10* (2006.01)

(52) U.S. Cl.
CPC ..... *H01Q 1/48* (2013.01); *H01Q 13/10* (2013.01); *H01Q 13/106* (2013.01)

(56) References Cited

U.S. PATENT DOCUMENTS

| | | | | |
|---|---|---|---|---|
| 9,997,822 | B2 * | 6/2018 | Han | H01Q 1/243 |
| 10,158,384 | B1 * | 12/2018 | Yarga | H01Q 13/103 |
| 10,581,153 | B2 * | 3/2020 | Edwards | H04M 1/02 |
| 10,658,749 | B2 * | 5/2020 | Ruaro | H01Q 1/273 |
| 2013/0099983 | A1 * | 4/2013 | Han | H04M 1/026 343/702 |
| 2015/0145740 | A1 | 5/2015 | Fratti et al. | |
| 2017/0110787 | A1 * | 4/2017 | Ouyang | H01Q 1/42 |
| 2018/0048052 | A1 | 2/2018 | Jin et al. | |
| 2018/0299488 | A1 * | 10/2018 | Jordan | H01Q 9/0407 |
| 2019/0097314 | A1 * | 3/2019 | Rajagopalan | H01Q 1/521 |
| 2019/0214708 | A1 * | 7/2019 | Ouyang | H01Q 1/42 |

FOREIGN PATENT DOCUMENTS

| | | |
|---|---|---|
| CN | 107611618 A | 1/2018 |
| CN | 206834323 | 1/2018 |
| CN | 108270080 | 7/2018 |
| EP | 0643437 A1 | 3/1995 |

OTHER PUBLICATIONS

Lei Bian et al: "Broadband Slot Antenna with Circular-Polarization Operation", Vehicular Technology Conference, 2008. VTC Spring 2008. IEEE, IEEE, Piscataway, NJ, USA, May 11, 2008 (May 11, 2008), pp. 353-355, figure 2.

Hammoodi Ali I et al: "A tunable dual-band square slot antenna with stub for DCS, ISM, and WiMAX applications", 2015 IEEE International Symposium on Antennas and Propagation & USNC/URSI National Radio Science Meeting, IEEE, Jul. 19, 2015 (Jul. 19, 2015), pp. 621-622, figure 1.

Zhang Shuai et al: "A Planar Switchable 3-D-Coverage Phased Array Antenna and Its User Effects for 28-GHz Mobile Terminal Applications", IEEE Transactions on Antennas and Propagation, IEEE Service Center, Piscataway, NJ, US, vo 1. 65, No. 12, Dec. 1, 2017 (Dec. 1, 2017), p. 1-p. 3; figures 2-4.

First office action of Chinese application No. 201810972185.0 dated Jan. 3, 2020.

Extended European search report of counterpart EP application No. 19193071.8 dated Dec. 19, 2019.

Second office action of Chinese application No. 201810972185.0 dated Jul. 30, 2020.

* cited by examiner

TERMINAL HOUSING AND TERMINAL

CROSS-REFERENCE TO RELATED APPLICATION

This application claims priority to Chinese Patent Application 201810972185.0, filed Aug. 23, 2018, the entire contents of which are incorporated herein by reference.

BACKGROUND

A mobile terminal such as a mobile phone typically comprises a terminal housing, a communication module, and an antenna unit. The communication module and the antenna unit are located inside the terminal housing. A radio-frequency (RF) port of the communication module is connected with the antenna unit through a feed line to receive and transmit a signal through the antenna unit. A through hole is formed in the terminal housing to allow the signal transmitted or received by the antenna unit to pass, so as to avoid blocking of the signal.

SUMMARY

The present disclosure relates to the field of communication technology and more particularly to a terminal housing and a terminal.

In a first aspect, there is provided a terminal housing, including a bottom metal frame, a feed line and a communication module, wherein the bottom metal frame is provided with a plurality of through holes;

each through hole is filled with a dielectric, and a feeding point and a grounding point are arranged at each side of each through hole, respectively;

one end of the feed line is connected with a radio frequency port of the communication module; and the other end of the feed line crosses the dielectric in each through hole to be connected with the corresponding feeding point, so as to enable the bottom metal frame and the dielectrics in the plurality of through holes to form an antenna unit.

In some embodiments, each through hole is circular or square, and each of the all through holes has the same size.

In some embodiments, the center of each through hole is located on a horizontal central axis of the bottom metal frame.

In some embodiments, at least three through holes are formed in the bottom metal frame, and distances between any adjacent two through holes are the same.

In some embodiments, a dielectric constant of the dielectric filled in each through hole is the same.

In some embodiments, the terminal housing further includes a microstrip line which includes the feed line, a dielectric substrate and a grounding substrate connected with the grounding point.

In some embodiments, the feed line is located above the dielectric substrate; and the grounding substrate is located below the dielectric substrate.

In some embodiments, a diameter of each through hole is 0.5-3 mm; the dielectric constant of the dielectric in each through hole is 1.875-11.25; and an operating frequency band of the antenna unit is 40-70 GHz.

In a second aspect, there is provided a terminal, including the terminal housing.

It should be understood that both the foregoing general description and the following detailed description are exemplary and explanatory only and are not restrictive of the disclosure. Other aspects and embodiments of the present disclosure will become clear to those of ordinary skill in the art in view of the following description and the attached drawings.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Various embodiments of the present disclosure are described below with specific examples, and other advantages and effects of the present disclosure can be easily understood by those skilled in the field of technology from the contents disclosed in this specification. The following description refers to the accompanying drawings in which same numeral references in different drawings may represent the same or similar elements unless otherwise indicated.

Apparently, the described embodiments are only a part of embodiments in the present disclosure, rather than all of them. The present disclosure can also be implemented or applied through different specific embodiments, and various details of the specification can also be modified or changed based on different viewpoints and applications without departing from the spirit of the present disclosure.

The inventors of the present disclosure have recognized that, with the continuous development of communication technologies, requirements for performance of an antenna unit, as a device for transmitting and receiving a wireless signal in a mobile terminal, are getting higher and higher, so that the performance of the antenna unit has become an important indicator for evaluating the overall performance of the terminal.

Figure 1:
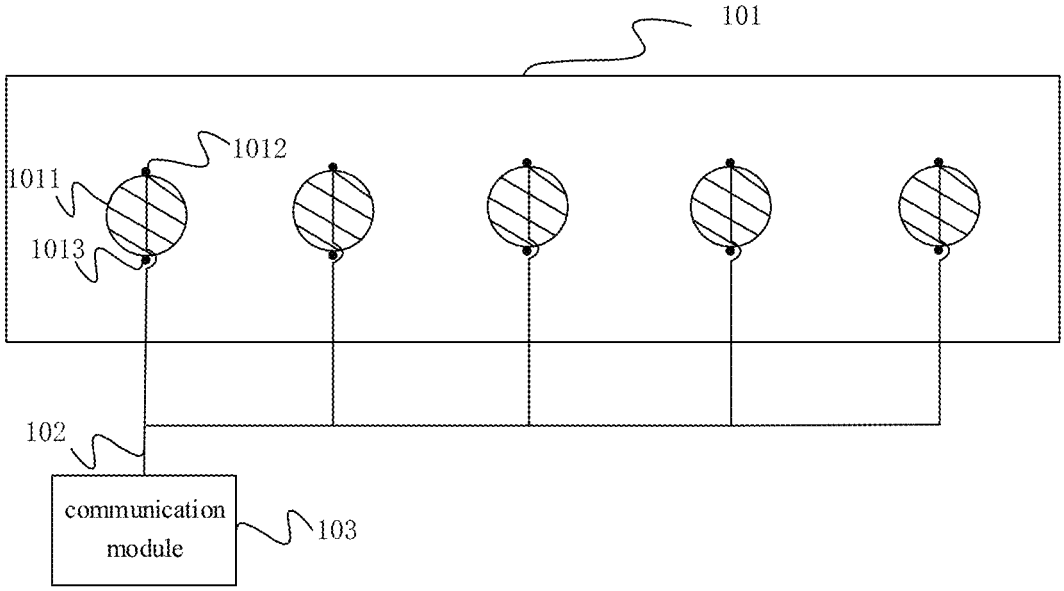
FIG. 1 is a schematic view of a structure of a terminal housing according to some embodiments.

FIG. 1 is a schematic view of a structure of a terminal housing according to some embodiments. Referring to FIG. 1, the terminal housing comprises a bottom metal frame 101, a feed line 102 and a communication module 103.

The various device components, blocks, or portions may have modular configurations, or are composed of discrete components, but nonetheless may be referred to as "modules" in general. In other words, the "modules" referred to herein may or may not be in modular forms.

In some embodiments of the present disclosure, the terminal housing comprises at least one metal frame which forms an edge frame body of the terminal housing. The terminal housing can further comprise metal frames of other portions, in addition to the bottom metal frame 101. For example, the terminal housing further comprises two side metal frames which are connected with the two ends of the bottom metal frame 101 respectively to form an integral metal frame.

In some embodiments, the terminal housing further comprises two side metal frames and one top metal frame. The two side metal frames are connected with the two ends of the bottom metal frame 101, respectively, and are connected with the two ends of the top metal frame, respectively, so as to form a whole metal frame of the terminal housing.

The bottom metal frame 101 is provided with a plurality of through holes 1011. The through holes 1011 are closed. That is, each through hole 1011 penetrates through the bottom metal frame 101, and the bottom metal frame 101 is distributed around each through hole 1011.

In some embodiments, each through hole 1011 is circular or square, or may be in other shapes. In addition, each through hole 1011 may have the same shape. In another possible implementation, each through hole 1011 has the same size. For example, the diameter of each circular through hole 1011 is the same, for example, the diameter of each through hole 1011 may be 0.5-3 mm, and in particular, may be 1.6 mm.

In some other embodiments, the center of each through hole 1011 is located on a horizontal central axis of the bottom metal frame 101, so that it is ensured that heights of the upper part of the bottom metal frame 101 and the lower part of the bottom metal frame 101 relative to each through hole 1011 are the same.

In some other embodiments, the bottom metal frame 101 is provided with at least three through holes 1011, and distances between any two adjacent through holes 1011 are the same.

In the above three possible implementations, the through holes 1011 of the same shape, or the through holes of the same size, or the through holes 1011 whose centers are located on the horizontal central axis of the bottom metal frame 101, or the through holes 1011 having the same distance are adopted, so that the through holes 1011 are distributed uniformly, thereby ensuring the appearance beauty of the terminal housing.

Moreover, slots of the antenna unit formed based on these through holes 1011 are distributed uniformly; the performance consistency of the sub-antenna units formed by the all through holes 1011 is ensured; and the performance of the antenna unit formed by superimposing the plurality of sub-antenna units is stable, so that radiation of uniform signals in all directions can be realized, thereby ensuring uniform transmission of signals, and improving the transmitting-receiving performance of the antenna unit.

In some embodiments of the present disclosure, each through hole 1011 in the bottom metal frame is filled with a dielectric having the same shape as each through hole 1011. The filled dielectric may be plastic, foam, glass, a fiber composite, or the like. In addition, the filled dielectric has a dielectric constant which affects the resonant frequency of the antenna unit. The larger the dielectric constant is, the lower the resonant frequency of the antenna unit is; and the smaller the dielectric constant is, the higher the resonant frequency of the antenna unit is. The requirement on the resonant frequency of the antenna unit can be met by filling the dielectric in each through hole 1011 in the bottom metal frame 101.

In some embodiments, the dielectric constant of the dielectric filled in each through hole 1011 can be 1.875-11.25, such as a dielectric constant of 6. Moreover, the dielectric constant of the dielectric filled in each through hole 1011 can be the same, such that the performance consistency of sub-antenna units formed by the respective through hole 1011 is ensured, and the performance of the antenna unit formed by superimposing the plurality of sub-antenna elements is stable, thereby ensuring the uniform transmission of signals, and improving the transmitting-receiving performance of the antenna unit.

A feeding point 1012 and a grounding point 1013 are arranged at each side of each through hole 1011, respectively. The feeding point 1012 is separated from the grounding point 1013 through the corresponding through hole 1011. That is, the bottom metal frame 101 is provided with the feeding point 1012 and the grounding point 1013 corresponding to each through hole 101; and the feeding point 1012 is located at one side of the through hole 1011, and the grounding point 1012 is located at the other side of the through hole 1011.

In some embodiments, for each through hole 1011, the feeding point 1012 and the grounding point 1013 can be located on the central axis of the through hole 1011, and at each side of the through hole 1011, respectively. Here, the central axis of the through hole 1011 refers to a line passing the center of the through hole 1011. For example, the feeding point 1012 is located at the upper side of the through hole 1011; and the grounding point 1013 is located at the lower side of the through hole 1011.

Alternatively, the feeding point 1012 is located at the lower side of the through hole 1011; and the grounding point 1013 is located at the upper side of the through hole 1011. Or, the feeding point 1012 is located at the left side of the through hole 1011; and the grounding point 1013 is located at the right side of the through hole 1011. Or, the feeding point 1012 is located at the right side of the through hole 1011; and the grounding point 1013 is located at the left side of the through hole 1011.

In the embodiment of the present disclosure, the communication module 103 is provided with a radio frequency port; one end of the feed line 102 is connected with the radio frequency port, and the other end of the feed line 102 crosses the dielectric in each through hole 1011 to be connected with the corresponding feeding point 1012, and is not connected with the corresponding grounding point 1013.

The other end of the feed line 102 crossing the dielectric in the through hole 1011 means that the feed line 102 is located inside the bottom metal frame 101; and the other end of the feed line 102 will pass through an area opposite to a cross section of the inner open end of the through hole 1011 when crossing the cross section of the inner open end of the through hole 1011. The feed line 102 is close to the through hole 1011, but does not contact the through hole 1011. Thus, when the feed line 102 is not in contact with the bottom metal frame 101, the transmission of electrical energy can be achieved through coupling, so that slot-coupled feeding is realized.

The communication module 103 can be part of a WIFI (Wireless Fidelity) module, a WLAN (Wireless Local Area Network) module, a Bluetooth module, or any module for controlling a signal transmitting-receiving function of the terminal.

The feed line 102 crosses the dielectric in each through hole 1011 and is connected with the respective corresponding feeding points 1012, so that a plurality of sub-antenna units are formed. The plurality of sub-antenna units formed in this manner together form the antenna unit. In addition, the plurality of through holes 1011 serve as slots of the antenna unit, so that the antenna unit formed based on the plurality of through holes 1011 is actually a slot antenna array.

During operation, a signal generated by the communication module 103 is transmitted to the feeding point 1012 through the radio frequency port and the feed line 102 to provide a voltage to the feeding point 1012, and a voltage of the grounding point 1013 serves as a reference voltage, so that a magnetic field signal is generated due to a voltage difference between the feeding point 1012 and the grounding point 1013, thereby realizing the signal transmitting-receiving function. The reference voltage may be 0 or other values.

The communication module 103 comprises a transmitting unit and a receiving unit. When the communication module 103 is to transmit a signal, the transmitting unit transmits the signal which is transmitted to the feeding point 1012 through the radio frequency port and the feed line 102; and at this time, the grounding point 1013 is set to a reference voltage, so that the antenna unit generates a magnetic field signal and radiates the magnetic field signal, thereby realizing the transmitting function of the antenna unit. Or, when the antenna unit receives a signal, the received signal is transmitted to the communication module 103 through the feed line 102 and the radio frequency port, and the receiving unit receives the transmitted signal, so as to realize the receiving function of the antenna unit.

That is, in the bottom metal frame 101, the plurality of through holes 1011 serve as slits of the antenna unit, and an area other than the plurality of through holes 1011 is a conductive area which can serve as a radiator of the antenna unit. A process of transmitting the signal through the antenna unit comprises: transmitting a signal through a transmitting unit, wherein the signal is transmitted to the feeding point 1012 through the radio frequency port and the feed line 102, so that there is a voltage difference between the feeding point 1012 and the grounding point 1013, and the radiator generates a current signal; converting the current signal to a magnetic field signal; and radiating the magnetic field signal.

A process of receiving the signal comprises: transmitting the magnetic field signal to the inside of the terminal housing through the through hole 1011, wherein the magnetic field signal cuts the feed line 102 as the feed line 102 passes through the area opposite to the cross section of the inner open end of the through hole 1011, so that there is a voltage difference at two sides of the feed line 102 through excitation, thereby generating a current signal, i.e., converting the magnetic field signal into a current signal through the feed line 102; transmitting the current signal to a receiving unit through the feed line 102 and the radio frequency port; and receiving the current signal through the receiving unit.

In some embodiments, the antenna unit can adopt an operating frequency band specified by a communication technology such as 4G (the fourth-generation mobile communication technology) or 5G (the fifth-generation mobile communication technology). For example, the operating frequency band of the antenna unit may be 40-70 GHz (Gigahertz), which constitutes a 5G antenna unit.

Figure 2:
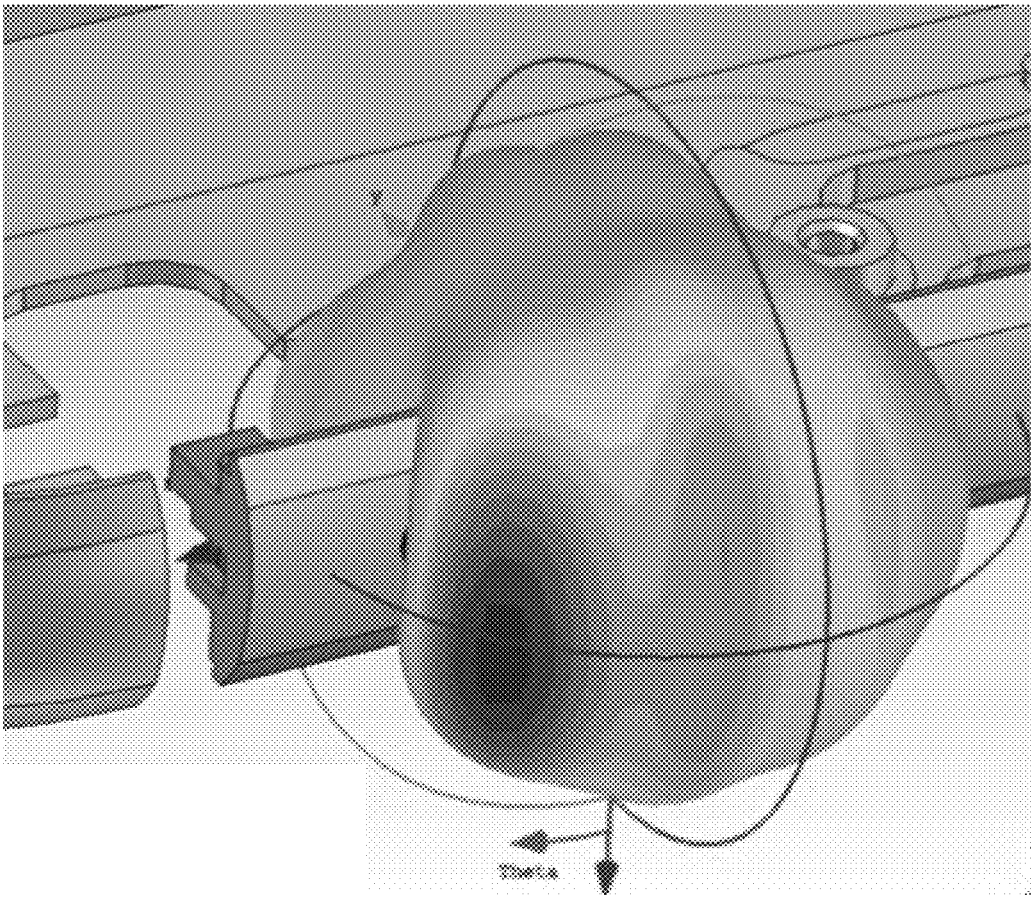
FIG. 2 is a schematic view showing a radiation direction of a sub-antenna unit according to some embodiments.

FIG. 2 is a schematic view showing a radiation direction of a sub-antenna unit according to some embodiments.

Referring to FIG. 2, the radiation energy of the sub-antenna unit in a direction towards the outer side of a bottom metal frame 101 is larger, and the radiation energy of the sub-antenna unit in a direction towards the inner side of the bottom metal frame 101 is smaller.

Figure 3:
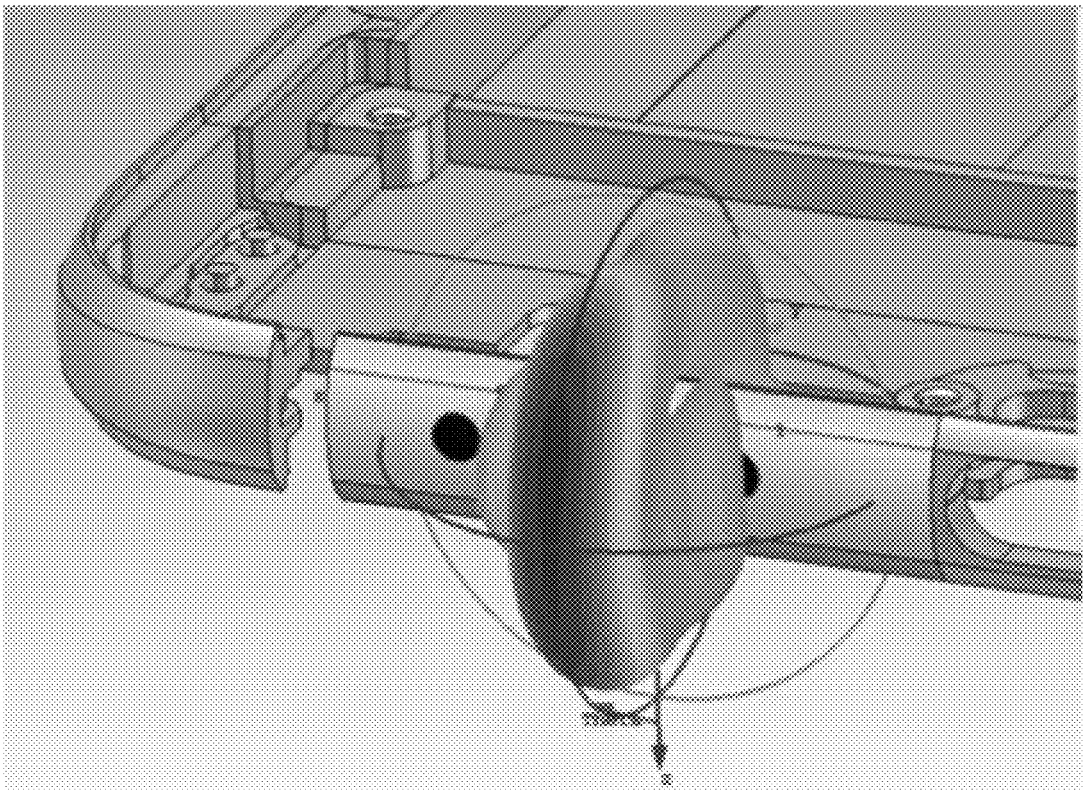
FIG. 3 is a schematic view showing a radiation direction of an antenna unit according to some embodiments.

FIG. 3 is a schematic view showing a radiation direction of an antenna unit according to some embodiments. Referring to FIG. 3, a plurality of sub-antenna units form the antenna unit, and the radiation direction of the antenna unit is more concentrated towards the outer side of the bottom metal frame 101, so that the radiation energy of the antenna unit in the direction towards the outer side of the bottom metal frame 101 is larger, and the transmitting-receiving capability is higher.

Moreover, in addition to the plurality of through holes 1011 for forming the antenna unit, another through hole, such as a sounding hole of a speaker or a USB (Universal Serial Bus) interface through hole, can be further formed in the bottom metal frame 101 of the terminal housing.

Figure 4:
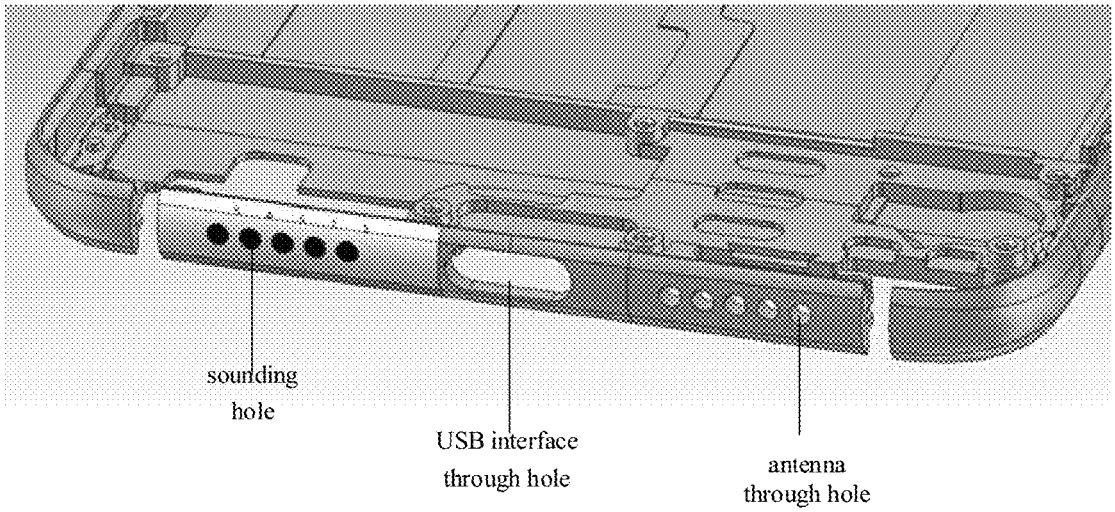
FIG. 4 is a schematic structure view of a bottom metal frame according to some embodiments.

For example, FIG. 4 is a schematic structure view of a bottom metal frame according to some embodiments. Referring to FIG. 4, a plurality of sounding holes, a USB interface through hole and a plurality of through hole 1011 of the antenna unit through holes are formed in the bottom metal frame 101. The plurality of sounding holes and the plurality of through holes 1011 are located at the left and right sides of the USB interface through hole, respectively. The number of the sounding holes is the same as that of the through holes 1011. The sounding holes and the through holes 1011 are symmetrical with respect to the vertical central axis of the bottom metal frame 101, so that the terminal housing is more beautiful.

The speaker is located inside the terminal housing and corresponds to the plurality of sounding holes in position. A USB interface is arranged in the USB interface through hole; and a data line can be inserted into the USB interface, so that the USB interface can be connected to various devices such as other terminals or charging devices through the data line.

As such, according to the terminal housing provided by the embodiment of the present disclosure, there is provided a design solution of an antenna unit. The bottle metal frame 101 is used as a part of the antenna unit; the bottom metal frame 101 of the terminal housing is provided with a plurality of through holes 1011; and each through hole 1011 is filled with a dielectric with a dielectric constant, so that a requirement on the resonant frequency of the antenna unit can be met.

One end of the feed line 102 is connected with a radio frequency port of the communication module 103, and the other end of the feed line crosses the dielectric in each through hole 1011 to be connected with the corresponding feeding point 1012. Thus, when the feed line 102 is not in contact with the bottom metal frame 101, the transmission of electrical energy can be achieved through coupling, so that slot-coupled feeding is realized.

The bottom metal frame 101 and the dielectric in the plurality of through holes 1011 form the antenna unit, so that a problem that a bottom metal frame 101 blocks a signal of an antenna unit when the antenna unit is arranged in the terminal housing is solved, thereby improving the performance of the antenna unit.

In addition, with the uniformly distributed through holes 1011, not only is the appearance beauty of the terminal housing ensured, but also slots of the antenna unit formed based on these through holes 1011 are distributed uniformly, so that the performance consistency of the sub-antenna units formed by the all through holes 1011 is ensured; and the performance of the antenna unit formed by superimposing the plurality of sub-antenna units is stable. Thus, radiation of uniform signals in all directions can be realized, thereby ensuring uniform transmission of signals, and improving the transmitting-receiving performance of the antenna unit.

Figure 5:
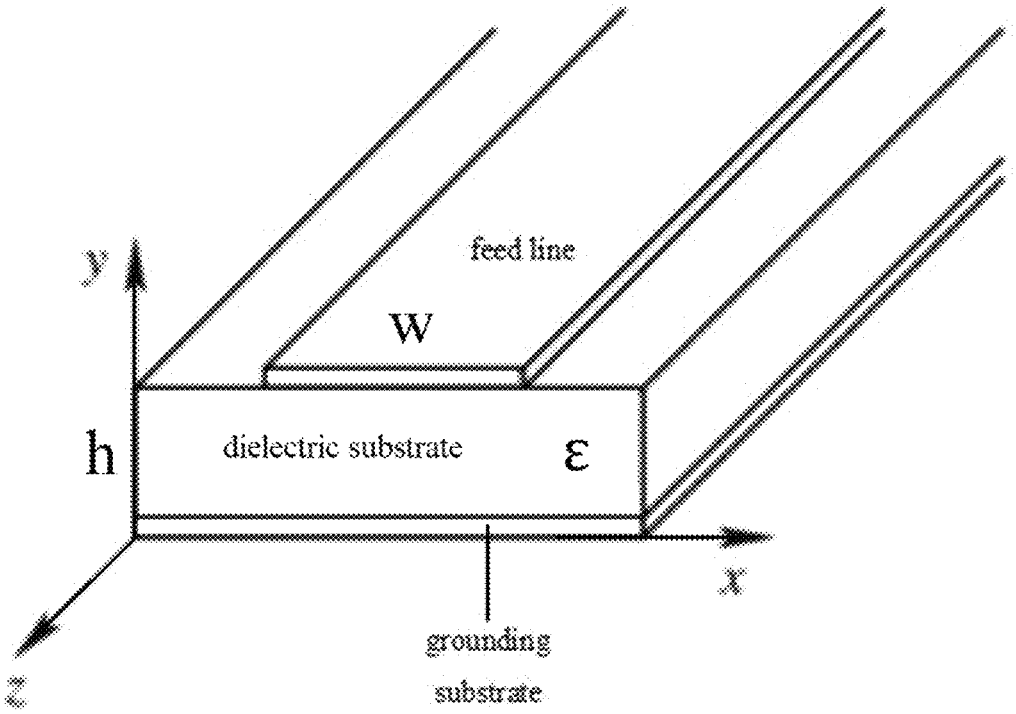
FIG. 5 is a schematic view of a structure of a microstrip line according to some embodiments.

FIG. 5 is a schematic view of a structure of a microstrip line according to some embodiments. In the embodiment of the present disclosure, the terminal housing further comprises the microstrip line comprising the feed line 102 shown in the above embodiment, a dielectric substrate and a grounding substrate.

The microstrip line may be arranged at any position of the terminal housing. All that is needed is to ensure that one end of the feeding line 102 is connected with the radio frequency port of the communication module 103, and the other end of the feed line crosses the dielectric in each through hole 1011 to be connected with the corresponding feeding point 1012.

Both the feed line and the grounding substrate are made of conductive materials. The dielectric substrate is located between the feed line and the grounding substrate, and is configured to separate the feed line from the grounding substrate. The feed line has the characteristics of high conductivity, good stability and low loss. The dielectric substrate is made of a material having a large dielectric constant and a small microwave loss. The grounding substrate is a metal grounding plate.

In some embodiments, the feed line is located above the dielectric substrate; and the grounding substrate is located below the dielectric substrate.

For example, the terminal housing comprises a bottom metal frame 101, a feed line 102 and a communication module 103. At least three circular through holes 1011 are formed in the bottom metal frame 101; and distances between any two adjacent circular through holes 1011 are the same. The bottom metal frame is distributed around each circular through hole 1011; and the centers of the all circular through holes 1011 are located on the horizontal central axis of the bottom metal frame 101.

Each circular through hole 1011 has a diameter of 1.6 mm, and is filled with a dielectric having a dielectric constant of 6. A feeding point 1012 and a grounding point 1013 are arranged at each side of each circular through hole 1011, respectively. The feeding point 1012 is arranged at the upper side of the circular through hole 1011; and the grounding point 1013 is arranged at the lower side of the circular through hole 1011.

The grounding point 1013 is connected with the grounding substrate, and a voltage is a reference voltage. A radio frequency port of the communication module 103 is connected with the feed line 102. The feed line 102 crosses the dielectric in each circular through hole 1011 to be connected with the corresponding feeding point 1012. A signal generated by the communication module 103 is transmitted to the feeding point 1012 through the radio frequency port and the feed line 102, so that the bottom metal frame 101 and the dielectric in the at least three circular through holes 1011 form a 5G antenna unit.

Figure 6:
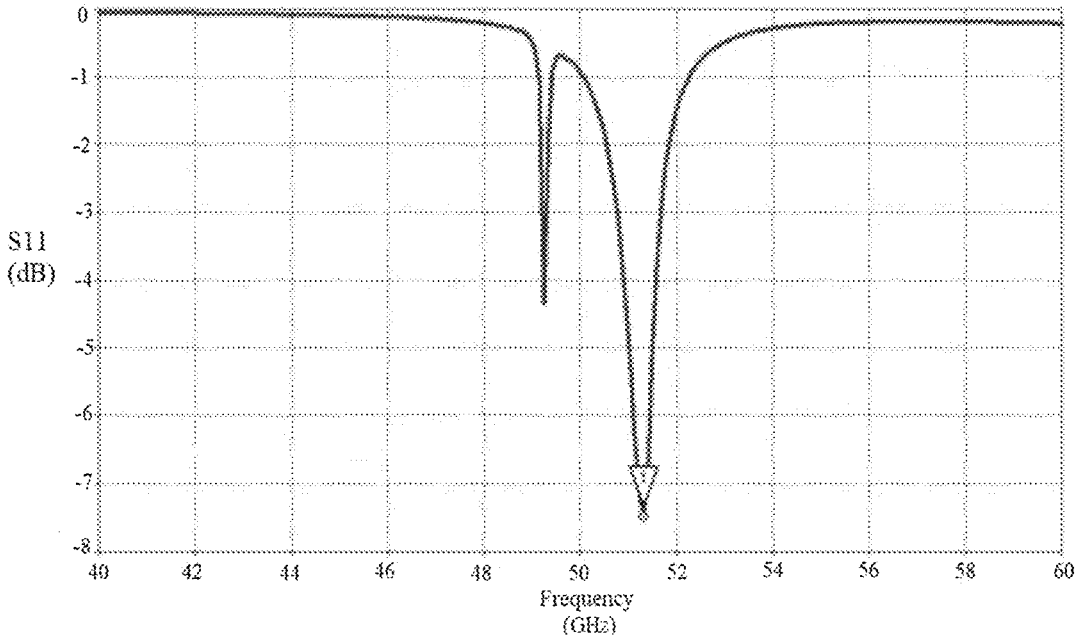
FIG. 6 is a schematic view showing a return loss characteristic curve of a 5G sub-antenna unit according to some embodiments.

FIG. 6 is a schematic view showing an S11 (an input reflection coefficient, namely, an input return loss) characteristic curve of a 5G sub-antenna unit according to some embodiments.

Referring to FIG. 6, input return losses of the 5G sub-antenna unit at different frequencies are different. The smaller the input return loss of the 5G sub-antenna unit is, the higher the performance of the 5G sub-antenna unit is. That is, at the lowest point of the curve, the performance the 5G sub-antenna unit is the highest.

Figure 7:
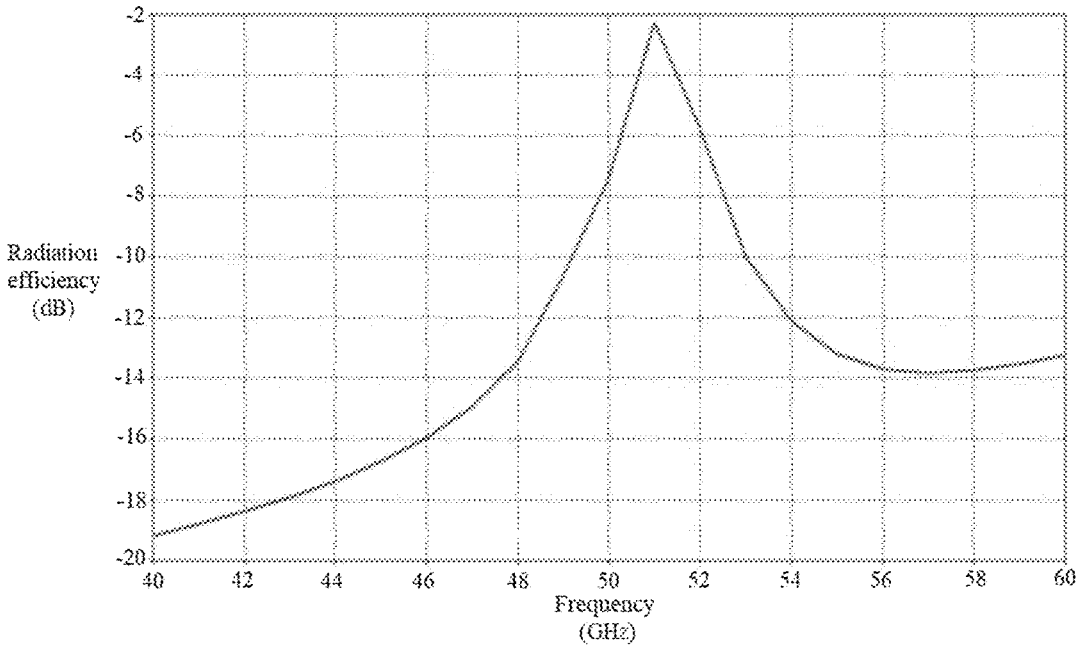
FIG. 7 is a schematic view showing a radiation efficiency characteristic curve of a 5G sub-antenna unit according to some embodiments.

FIG. 7 is a schematic view showing a radiation efficiency characteristic curve of a 5G sub-antenna unit according to some embodiments. Referring to FIG. 7, radiation efficiencies of the 5G sub-antenna unit at different frequencies are different. That is, the larger a radiation efficiency value is, the higher the radiation efficiency of the 5G sub-antenna unit is. That is, at the highest point of the curve, the radiation efficiency of the 5G sub-antenna unit is the highest.

Referring to FIGS. 6 and 7, the performance of the 5G sub-antenna unit is the highest when the operating frequency is 51 GHz.

Various embodiments of the present disclosure further provide a terminal. The terminal comprises the terminal housing as described in the foregoing embodiment, and includes all structures and functions of the terminal housing. Of course, the terminal further comprises a display screen, a front terminal housing, a rear terminal housing, and other electronic components in the terminal, such as a speaker and a microphone. The antenna unit formed in the above terminal housing cooperates with the other electronic components in the terminal to realize a communication function of the terminal. The specific composition of the terminal is not limited in the present disclosure.

In some embodiments, the terminal cannot be configured with another antenna unit except the antenna unit formed in the terminal housing. In some embodiments, another antenna unit can be configured inside the terminal housing, thereby configuring a plurality of antenna units on the terminal, and realizing the signal transmitting-receiving function through the plurality of antenna units.

At least some embodiments provided by the present disclosure have one or more of the following advantageous benefits:

According to the terminal housing provided by the embodiment of the present disclosure, there is provided a design solution of an antenna unit. The bottle metal frame is used as a part of the antenna unit; a plurality of through holes are formed in the bottom metal frame of the terminal housing; and each through hole is filled with a dielectric material with a dielectric constant, so that a requirement on the resonant frequency of the antenna unit can be met. One end of the feed line is connected with a radio frequency port of the communication module, and the other end of the feed line crosses the dielectric in each through hole to be connected with the corresponding feeding point. Thus, when the feed line is not in contact with the bottom metal frame, the transmission of electrical energy can be achieved through coupling, so that slot-coupled feeding is realized. The communication module is connected with a feeding point through a feed line. The bottom metal frame and the dielectrics in the plurality of through holes is used as a part of the antenna unit, and forms the antenna unit with the dielectric in the plurality of through holes, so that a problem that a bottom metal frame blocks a signal of an antenna unit when the antenna unit is arranged in the terminal housing is solved, thereby improving the performance of the antenna unit.

Other embodiments of the present disclosure will be apparent to those skilled in the art from consideration of the specification and practice of the present disclosure. This application is intended to cover any variations, uses, or adaptations of the present disclosure following the general principles thereof and including common knowledge or commonly used technical measures which are not disclosed herein. The specification and embodiments are to be considered as exemplary only, with a true scope and spirit of the present disclosure is indicated by the following claims.

It will be appreciated that the present disclosure is not limited to the exact construction that has been described above and illustrated in the accompanying drawings, and that various modifications and changes can be made without departing from the scope thereof. It is intended that the scope of the present disclosure only be limited by the appended claims.

The terms "first" and "second" are used for descriptive purposes only and are not to be construed as indicating or implying a relative importance or implicitly indicating the number of technical features indicated. Thus, elements referred to as "first" and "second" may include one or more of the features either explicitly or implicitly. In the description of the present disclosure, "a plurality" indicates two or more unless specifically defined otherwise.

In the present disclosure, the terms "installed," "connected," "coupled," "fixed" and the like shall be understood broadly, and may be either a fixed connection or a detachable connection, or integrated, unless otherwise explicitly defined. These terms can refer to mechanical or electrical connections, or both. Such connections can be direct connections or indirect connections through an intermediate medium. These terms can also refer to the internal connections or the interactions between elements. The specific meanings of the above terms in the present disclosure can be understood by those of ordinary skill in the art on a case-by-case basis.

In the description of the present disclosure, the terms "one embodiment," "some embodiments," "example," "specific example," or "some examples," and the like may indicate a specific feature described in connection with the embodiment or example, a structure, a material or feature included in at least one embodiment or example. In the present disclosure, the schematic representation of the above terms is not necessarily directed to the same embodiment or example.

It will be understood that when an element such as a layer, region, or other structure is referred to as being "on" or extending "onto" another element, it can be directly on or extend directly onto the other element or intervening elements can also be present. In contrast, when an element is referred to as being "directly on" or extending "directly onto" another element, there are no intervening elements present.

Likewise, it will be understood that when an element such as a layer, region, or substrate is referred to as being "over" or extending "over" another element, it can be directly over or extend directly over the other element or intervening elements can also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements can be present. In contrast, when an element is referred to as being "directly connected" or "directly coupled" to another element, there are no intervening elements present.

Relative terms such as "up" or "down" or "left" or "right" or "below" or "above" or "upper" or "lower" or "horizontal" or "vertical" can be used herein to describe a relationship of one element, layer, or region to another element, layer, or region as illustrated in the drawings. It will be understood that these terms and those discussed above are intended to encompass different orientations of the device in addition to the orientation depicted in the drawings.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Moreover, the particular features, structures, materials, or characteristics described may be combined in a suitable manner in any one or more embodiments or examples. In addition, various embodiments or examples described in the specification, as well as features of various embodiments or examples, may be combined and reorganized.

In some embodiments, the control and/or interface software or app can be provided in a form of a non-transitory computer-readable storage medium having instructions stored thereon is further provided. For example, the non-transitory computer-readable storage medium may be a ROM, a RAM, a CD-ROM, a magnetic tape, a floppy disk, optical data storage equipment, a flash drive such as a USB drive or an SD card, and the like.

Implementations of controlling of the antenna, processing of the signals received by or emitted from the antenna, and the operations described in this disclosure can be implemented in digital electronic circuitry, or in computer software, firmware, or hardware, including the structures disclosed herein and their structural equivalents, or in combinations of one or more of them. Implementations of the subject matter described in this disclosure can be implemented as one or more computer programs, i.e., one or more portions of computer program instructions, encoded on one or more computer storage medium for execution by, or to control the operation of, data processing apparatus.

Alternatively, or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them.

Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, drives, or other storage devices). Accordingly, the computer storage medium may be tangible.

The operations described in this disclosure can be implemented as operations performed by a data processing apparatus on data stored on one or more computer-readable storage devices or received from other sources.

The devices in this disclosure can include special purpose logic circuitry, e.g., an FPGA (field-programmable gate array), or an ASIC (application-specific integrated circuit).

The device can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The devices and execution environment can realize various different computing model infrastructures, such as web services, distributed computing, and grid computing infrastructures.

A computer program (also known as a program, software, software application, app, script, or code) can be written in any form of programming language, including compiled or interpreted languages, declarative or procedural languages, and it can be deployed in any form, including as a stand-alone program or as a portion, component, subroutine, object, or other portion suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more portions, sub-programs, or portions of code). A computer program can be deployed to be executed on one computer or on multiple computers that are located at one site or distributed across multiple sites and interconnected by a communication network.

The processes and logic flows described in this disclosure can be performed by one or more programmable processors executing one or more computer programs to perform actions by operating on input data and generating output. The processes and logic flows can also be performed by, and apparatus can also be implemented as, special purpose logic circuitry, e.g., an FPGA, or an ASIC.

Processors suitable for the execution of a computer program include, by way of example, both general and special purpose microprocessors, and any one or more processors of any kind of digital computer. Generally, a processor will receive instructions and data from a read-only memory, or a random-access memory, or both. Elements of a computer can include a processor configured to perform actions in accordance with instructions and one or more memory devices for storing instructions and data.

Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few.

Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented with a computer and/or a display device, e.g., a VR/AR device, a head-mount display (HMD) device, a head-up display (HUD) device, smart eyewear (e.g., glasses), a CRT (cathode-ray tube), LCD (liquid-crystal display), OLED (organic light emitting diode), a flexible display, or any other monitor for displaying information to the user and a keyboard, a pointing device, e.g., a mouse, trackball, etc., or a touch screen, touch pad, etc., by which the user can provide input to the computer.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination.

Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

It is intended that the specification and embodiments be considered as examples only. Other embodiments of the disclosure will be apparent to those skilled in the art in view of the specification and drawings of the present disclosure. That is, although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the example embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

The invention claimed is:

1. A terminal housing, comprising:

a bottom metal frame;

a feed line; and a communication module; wherein:

the bottom metal frame is provided with a plurality of through holes;

a plurality of sounding holes and a USB interface through hole are provided in the bottom metal frame, wherein the plurality of sounding holes and the plurality of through holes are located at the left and right sides of the USB interface through hole, respectively;

each through hole is filled with a dielectric;

a feeding point and a grounding point are arranged at each side of each through hole, respectively;

one end of the feed line is connected with a radio frequency port of the communication module;

another end of the feed line crosses the dielectric in each through hole to be connected with the corresponding feeding point, so as to enable the bottom metal frame and the dielectrics in the plurality of through holes to form an antenna unit; and the plurality of through holes are slots of the antenna unit.

2. The terminal housing of claim 1, wherein the each through hole is circular or square, and has a same size.

3. The terminal housing of claim 1, wherein a center of each through hole is located on a horizontal central axis of the bottom metal frame.

4. The terminal housing of claim 1, wherein at least three through holes are formed in the bottom metal frame, and distances between any two adjacent through holes are same.

5. The terminal housing of claim 1, wherein a dielectric constant of the dielectric filled in each through hole is same.

6. The terminal housing of claim 1, further comprising a microstrip line including the feed line, a dielectric substrate, and a grounding substrate connected with the grounding point.

7. The terminal housing of claim 6, wherein the feed line is located above the dielectric substrate; and the grounding substrate is located below the dielectric substrate.

8. The terminal housing of claim 1, wherein:

a diameter of the each through hole is 0.5-3 mm;

the dielectric constant of the dielectric in each through hole is 1.875-11.25; and an operating frequency band of the antenna unit is 40-70 GHz.

9. The terminal housing of claim 1, wherein the each through hole in the bottom metal frame is filled with a dielectric having a same shape as the each through hole.

10. A mobile terminal, comprising a terminal housing, an antenna, a display screen, and a processor, wherein the terminal housing comprises:

a bottom metal frame;

a feed line; and a communication module; wherein:

the bottom metal frame is provided with a plurality of through holes;

a plurality of sounding holes and a USB interface through hole are provided in the bottom metal frame, wherein the plurality of sounding holes and the plurality of through holes are located at the left and right sides of the USB interface through hole, respectively;

each through hole is filled with a dielectric;

a feeding point and a grounding point are arranged at each side of each through hole, respectively;

one end of the feed line is connected with a radio frequency port of the communication module;

another end of the feed line crosses the dielectric in each through hole to be connected with the corresponding feeding point, so as to enable the bottom metal frame and the dielectrics in the plurality of through holes to form an antenna unit; and the plurality of through holes are slots of the antenna unit.

11. The terminal of claim 10, wherein the each through hole is circular or square, and has a same size.

12. The terminal of claim 10, wherein a center of the each through hole is located on a horizontal central axis of the bottom metal frame.

13. The terminal of claim 10, wherein at least three through holes are formed in the bottom metal frame, and distances between any two adjacent through holes are the same.

14. The terminal of claim 10, wherein a dielectric constant of the dielectric filled in the each through hole is the same.

15. The terminal of claim 10, further comprising a microstrip line which comprises the feed line, a dielectric substrate and a grounding substrate connected with the grounding point.

16. The terminal of claim 15, wherein the feed line is located above the dielectric substrate; and the grounding substrate is located below the dielectric substrate.

17. The terminal of claim 10, wherein a diameter of each through hole is 0.5-3 mm; the dielectric constant of the dielectric in each through hole is 1.875-11.25; and an operating frequency band of the antenna unit is 40-70 GHz.

18. The terminal of claim 10, wherein the each through hole has a same shape.

19. The terminal of claim 10, wherein the each through hole in the bottom metal frame is filled with a dielectric having a same shape as the each through hole.

* * * * *